US006155381A

United States Patent [19]

White et al.

[11] Patent Number: 6,155,381

[45] Date of Patent: Dec. 5, 2000

[54] CHECKOUT COUNTER WITH TRANSFER PLATE CONSTRUCTION

[75] Inventors: Harold L. White, Jacksonville; Dennis E. Finegan, Orange Park, both of Fla.

[73] Assignee: Load King Manufacturing Co., Jacksonville, Fla.

[21] Appl. No.: 09/190,732

[22] Filed: Nov. 12, 1998

[51] Int. Cl.[7] ..... A47F 9/04

[52] U.S. Cl. ..... 186/68; 198/860.5; 312/140.1

[58] Field of Search ..... 186/61–69; 198/836.1, 198/836.3, 860.3, 860.4, 860.5; 312/140.1, 140.4, 111; 411/179; 403/382

[56] References Cited

U.S. PATENT DOCUMENTS 1,888,742 11/1932 Schumm .
2,102,558 12/1937 Johnson ..... 411/179
2,723,728 11/1955 Crawford ..... 186/66
4,618,032 10/1986 Woolf ..... 186/61

*Primary Examiner*—F. J. Bartuska
*Attorney, Agent, or Firm*—Allen, Dyer, Doppelt, Milbrath & Gilchrist, P.A.

[57] ABSTRACT

A construction for checkout counters useful with security and payment equipment which permits a customer to conduct price scans and enter payment without the assistance of a cashier includes intake, security and packaging modules, with the security module having an internal recess adapted to support required security equipment. Access to the internal recess is facilitated with sidewall ports covered by access panels which can be removed without access to the internal recess. A facile two-part transfer plate assembly is provided at the intake end of the security module, and a rigid slotted construction for lateral cross braces is also employed.

22 Claims, 6 Drawing Sheets

CHECKOUT COUNTER WITH TRANSFER PLATE CONSTRUCTION

BACKGROUND OF THE INVENTION

1. Field of the Invention

The present invention relates generally to checkout counters of the type used in supermarkets, department stores and other retail facilities. In particular, the present invention relates to checkout counters designed for use with security and payment equipment which permits a customer to conduct price scans and enter payment without the assistance of a cashier.

2. Description of the Prior Art

The prior art teaches a variety of constructions for checkout counters of the type used in supermarkets, department stores and similar retail facilities. Generally, a checkout counter is characterized by an elongated counter having a horizontal conveyor for moving articles from an intake end to a cashier's location. Typically, a uniform price code (UPC) reader is embedded in the counter adjacent the cashier's location at the discharge end of the conveyor. The counter usually also includes a package area rearwardly from the cashier's location. Such checkout counters are constructed from modules which are made separately by the manufacturer and then assembled together during installation at the retail facility. Of course, the type of checkout counter described above is designed for use by a full-time cashier.

Recently, there have been suggestions for the use of checkout counters which permit the customer to conduct the UPC price scans and enter payment entirely without the assistance of a cashier. One such self-checkout counter is marketed by Productivity Solutions Incorporated of Jacksonville, Florida. Self-checkout counters have unusual requirements. For example, special security equipment must be supported by the counter above and below the conveyor and counter surface. The security equipment presently used in these applications is significantly more sensitive than the electric motors, belt drives and the like within a conventional checkout counter, and therefore the construction of a self-checkout counter must be both rigid and not susceptible to misalignment. Further, the security equipment used in self-checkout counters requires periodic calibration and maintenance, and ease of access to the internal security equipment is an important factor.

SUMMARY OF THE INVENTION

The present invention is directed to a facile modular self-checkout counter construction which, when the modules are assembled together, provides the desired rigidity and which is also not susceptible to misalignment. Further, the self-checkout counter construction of the present invention permits access to the internal recesses of the counter to permit calibration and maintenance of security equipment located therein.

In a preferred embodiment, the present invention utilizes three separate modules: an intake module, a security module and a packaging module. The intake module is provided with a recess extending through the top surface thereof and which is dimensioned to receive a conventional UPC reader, in order to permit the customer to enter pricing information for articles being purchased by the customer. The intake module is attached to the forward end of the security module, with the security module supporting a conveyor for receiving articles passed across the UPC reader by the customer. The security module includes a recess below the conveyor for receiving sensitive security equipment and an upper bracket for receiving similar security equipment. The security equipment is designed to monitor the articles passing across the conveyor to insure that the articles are in fact those scanned by the customer with the UPC reader at the intake module. The conveyor then passes articles scanned by the customer and verified in the security module onto a top surface of the packaging module.

The security module is provided with a number of important features in accordance with the present invention. For example, the security module includes a support surface at the bottom of the interior recess which is specifically designed to support sensitive security equipment such as a load cell or the like which are used in such applications to monitor and verify articles being purchased by the consumer. In order to permit ready access to the internal security equipment, the sides of the security module are provided with access ports which in turn are covered by exterior accent panels. The accent panels are removably fixed to the sides of the security module with special purpose fasteners that permit removal of the accent panels without access to the interior recess of the security module. All cross-bracing of the modules, including the security module, are carried out utilizing an offset dado feature which permits the flat bottom of each cross brace to be precisely located without concern for later misalignment. The security module adjacent the intake to the conveyor is also provided with a transfer plate assembly formed from two interlocking members. The construction of the transfer plate assembly provides a safe and facile transition for articles being passed onto the intake end of the conveyor.

Other important features of the self-checkout counter construction of the present invention will be understood from the drawings and the detailed description which follow next.

THE DRAWING

DETAILED DESCRIPTION

Figure 1:
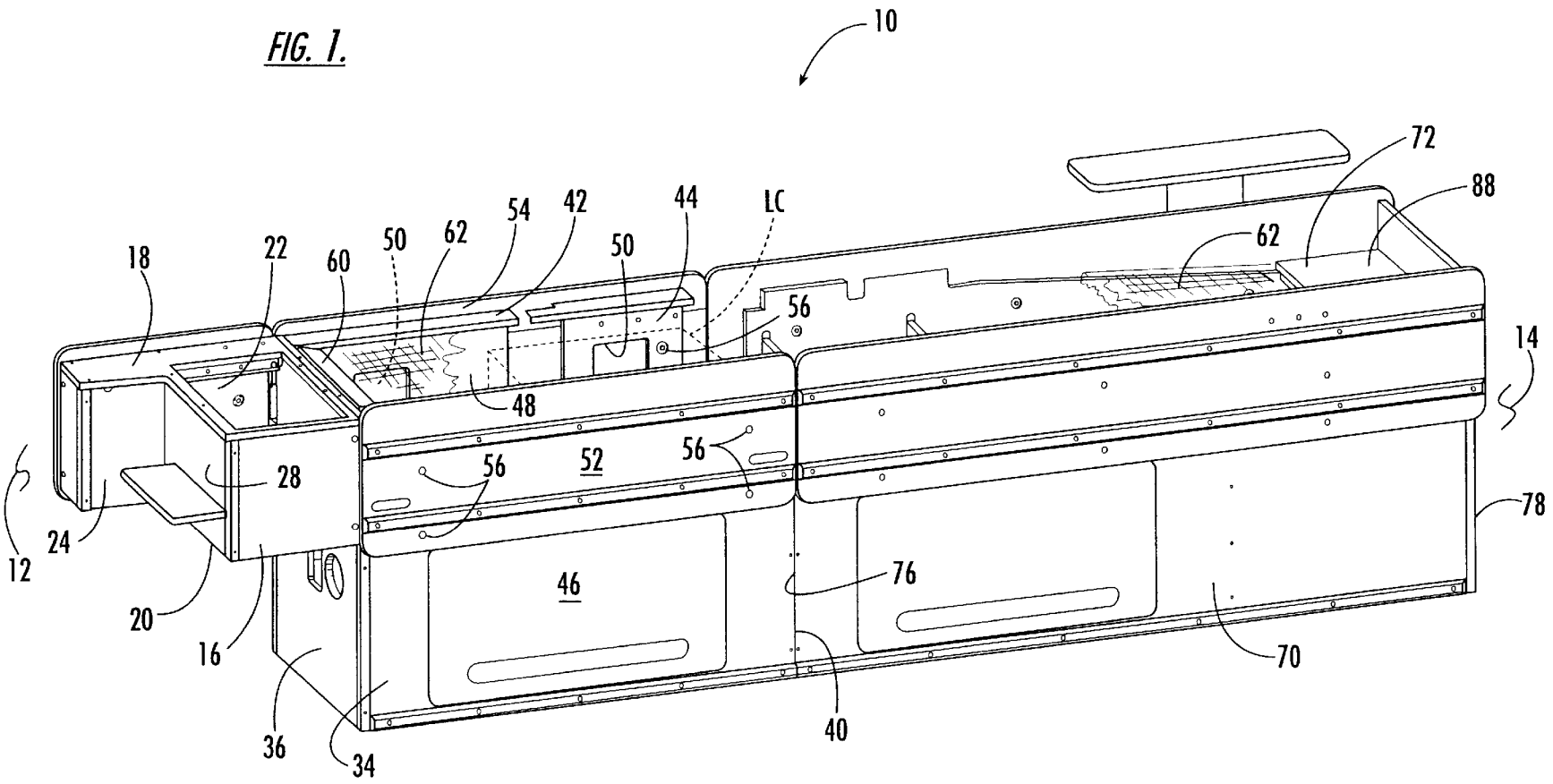
FIG. 1 is a perspective view of the self-checkout counter construction of the present invention, with a portion of the conveyor partially cut away and with a portion of the security equipment shown in dashed lines.

A preferred embodiment of a self-checkout counter construction in accordance with the present invention will now be described with reference to the drawing. It will of course be understood by those skilled in the art that a number of variations in the construction may be employed without departing from the spirit and scope of this invention.

Figure 2:
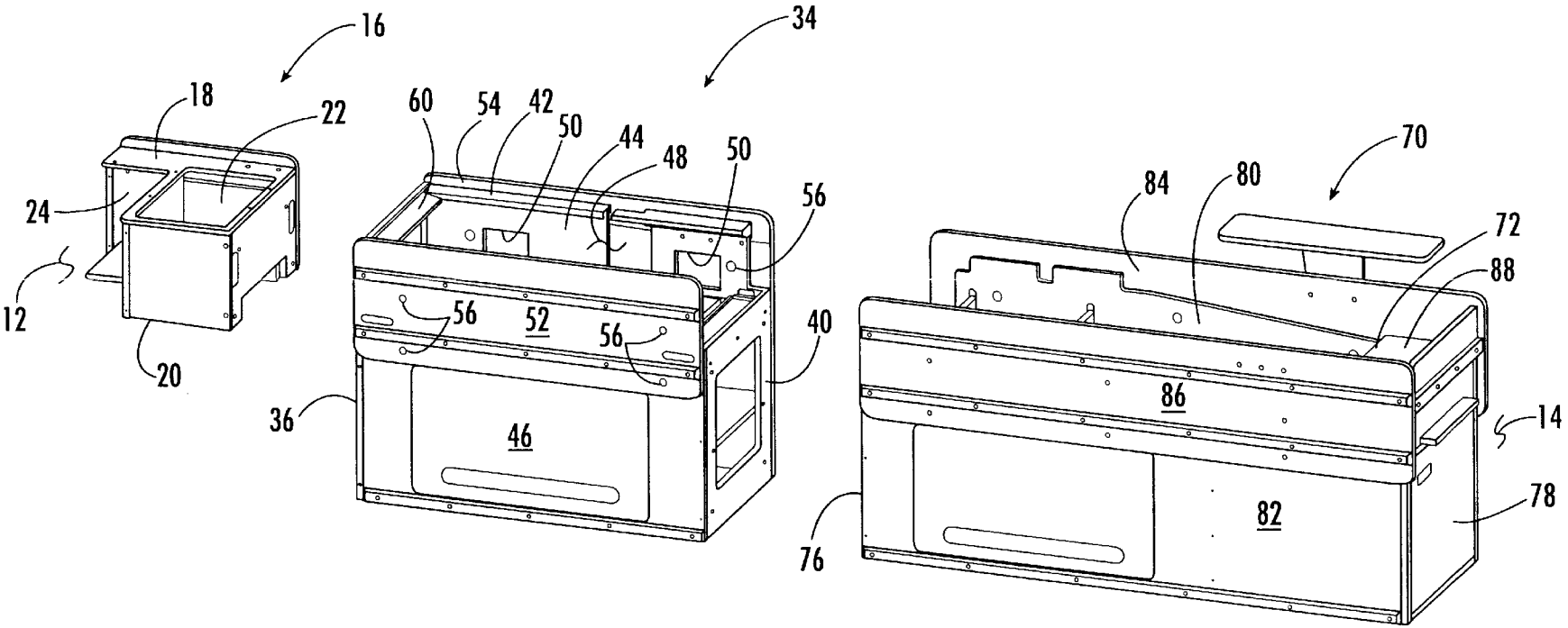
FIG. 2 is an exploded perspective view of the self-checkout counter construction shown in FIG. 1.

The checkout counter construction shown in FIGS. 1 and 2 is referred to generally using the reference numeral 10. The counter 10 includes a forward end 12 and a rearward end 14. An intake module 16 is positioned at the forward end 12 and is attached at the intake end 36 of a security module 34. As shown in FIGS. 1 and 2, the intake module 16 includes a top surface 18 and a bottom surface 20, the intake module 16 being dimensioned between the top and bottom surfaces 18, 20 in such a manner that the top surface 18 lies generally in the plane of a conveyor 62 extending across the top surface 42 of the security module 34. The bottom surface 20 of the intake module 16 is dimensioned above the floor upon which the remainder of the counter 10 rests.

The intake module 16 includes a recess 22 extending from the top surface 18 interiorly, the recess 22 being dimensioned to receive a UPC reader in a conventional manner. The intake module 16 further includes a recess defined by walls 24, 28, which recess adapts to receive the front end of a shopping cart.

The security module 34 is defined by the intake end 36 and a. rearward end 40 between which extend sidewalls 44 and 46. The sidewalls 44 and 46 together with the top 42 of the security module 34 enclose an internal recess 48 which is adapted to receive security equipment, an example of which is shown as a load cell LC by dashed lines in FIG. 1.

Figure 3:
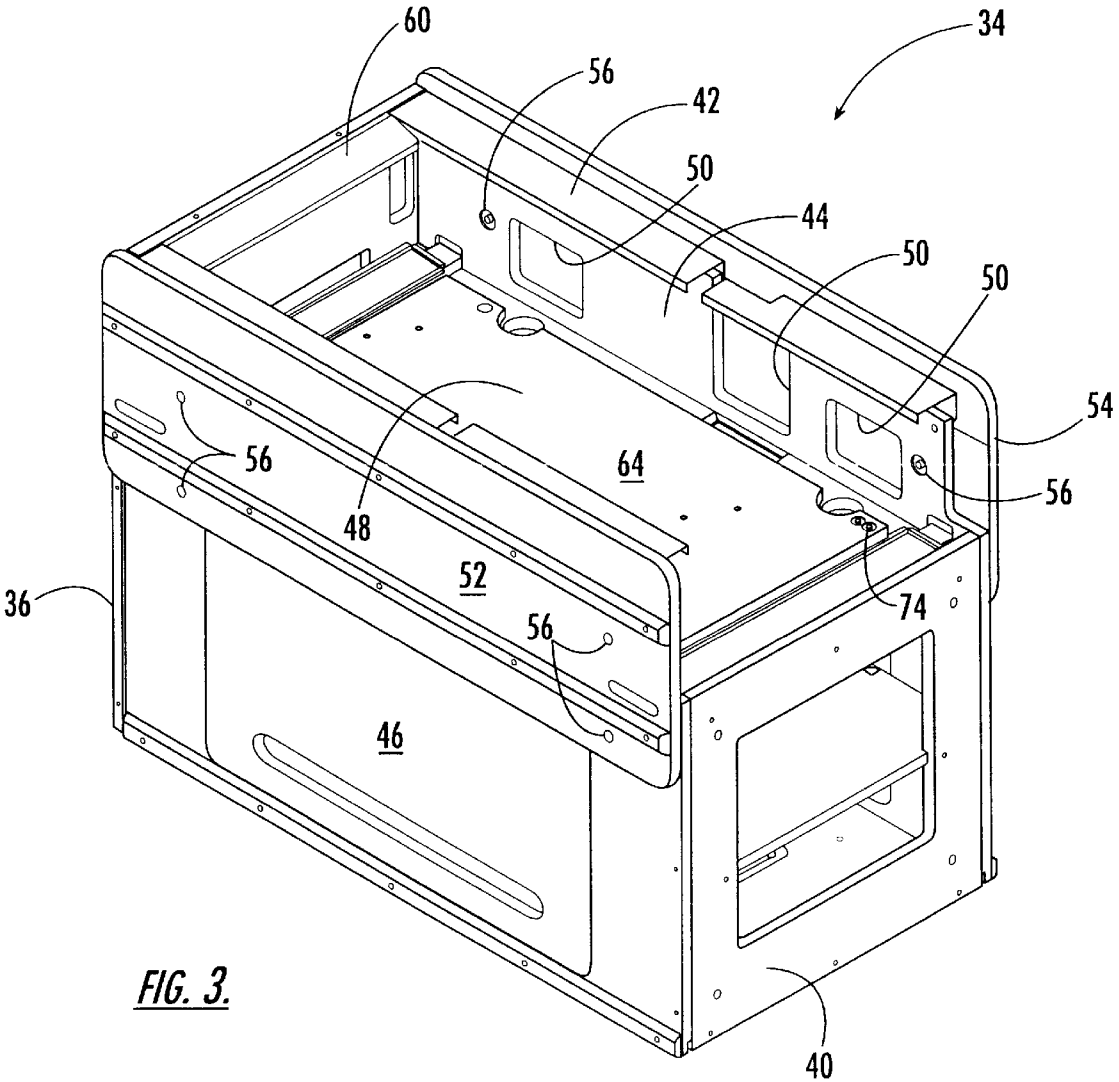
FIG. 3 is a perspective view of the security module for the checkout counter construction of the present invention, with the top conveyor and the security equipment removed.

Now referring to FIGS. 1–3, the sidewalls 44 and 46 of the security module 34 include plural access ports 50 which communicate with the internal recess 48. In order to cover the access ports 50, there is provided a pair of accent panels 52, 54 each of which is fixed along the outside of a corresponding sidewall 44, 46 with special fasteners 56 which permit the access panels 52, 54 to be quickly removed without access to the internal recess 48. The details regarding these special fasteners 56 is discussed below with respect to FIG. 8.

As shown in FIG. 1, a conveyor 62 is provided which extends along the top surface 42 of the security module 34 and terminates at a discharge end 72 of a packaging module 70, as is discussed further below. A transfer plate assembly 60 is provided at the intake end 36 of the security module 34 (note FIGS. 1 and 3). The details of the transfer assembly are described below with reference to FIGS. 6 and 7.

With specific reference to FIG. 3, the security module 34 also includes a security equipment support platform 64 which is removably mounted at the bottom of the internal recess 48. Because of the sensitive nature of the load cell LC and other security equipment that may be used in self-checkout counters to which the present invention is directed, this platform is imparted with close tolerances, and is easily removed from the security module 34 with fasteners 74 extending through the platform 64.

The counter construction 10 further includes a packaging module 70 having a forward end 76 abutting the rearward end 40 of the security module 34, the packaging module 70 further including a rearward end 78. The packaging module 70 includes opposing sidewalls 80, 82, with like accent panels 84, 86 attached to respective ones of the sidewalls 80, 82. The conveyor 62 extends to the discharge end 72 of the packaging module 70 in order to pass the customer's merchandise on to a packaging surface 88 of the packaging module.

It is customary in the construction of prior art checkout counters to provide lateral cross-braces extending between opposing sides in order to impart rigidity to the construction. It has not in the past been necessary to be overly concerned with the stability of the joint between the cross-brace and the sides in such prior art checkout counter constructions. However, in the particular self-checkout application to which the construction 10 of the present invention is directed, stability, rigidity and dimensional preciseness becomes much more critical because of the sensitive nature of load cell LC and other security equipment. Accordingly, the construction 10 of the present invention employs a T-ear offset dado construction at the bottom of each cross-brace sidewall interface in order to achieve these desired characteristics. This construction feature is shown in FIGS. 4 and 5 and described next.

Figure 5:
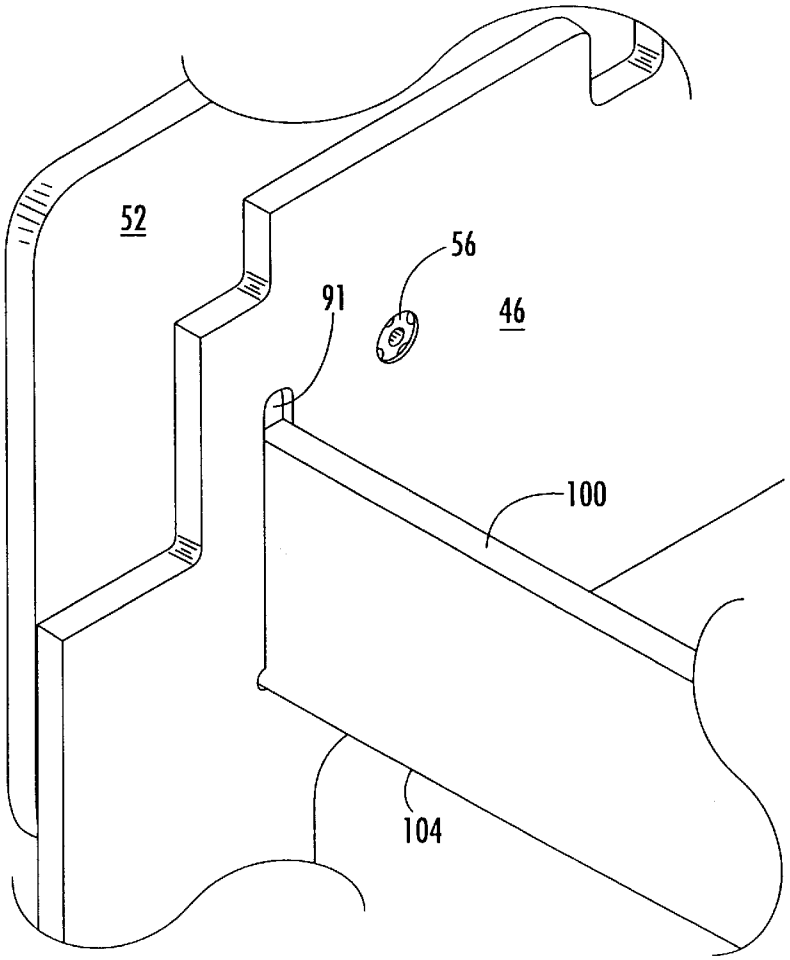
FIGS. 4 and 5 are cut away perspective views illustrating a construction detail used in the checkout counter construction of FIGS. 1 and 2.
Figure 4:
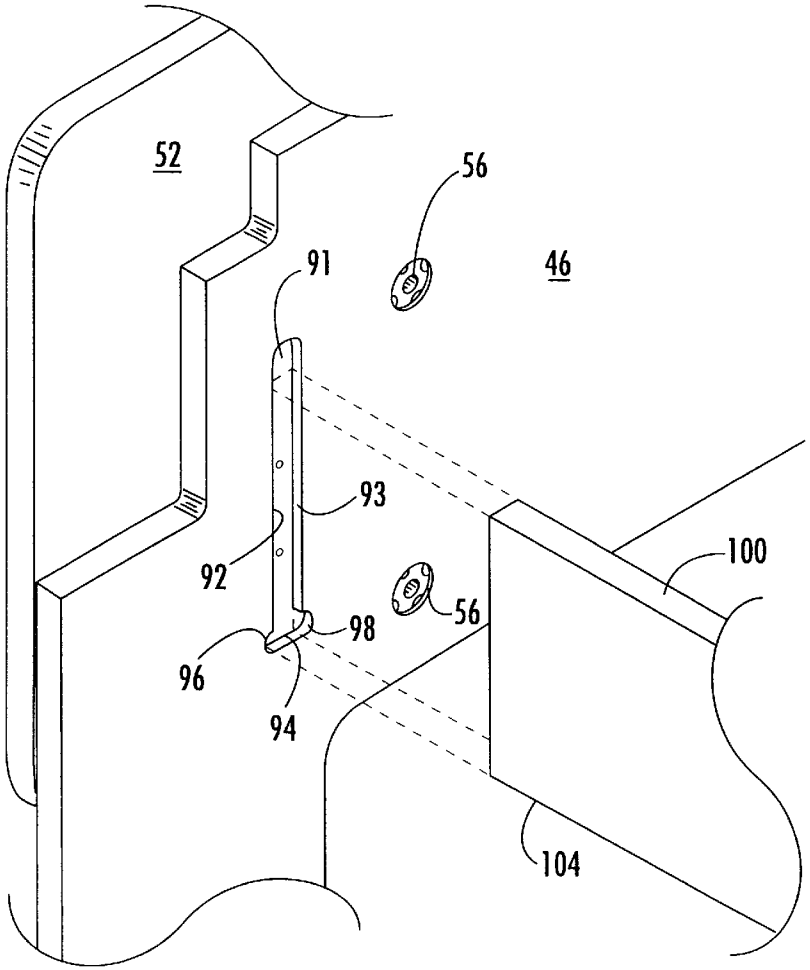

In FIGS. 4 and 5, the interface construction of a brace member 100 with the sidewall 46 of the security module 34 is shown by way of example. It will of course be understood that the example shown in FIGS. 4 and 5 has applicability for the lateral braces used in the security and packaging modules 34, 70 in the construction 10.

As shown in FIGS. 4 and 5, the brace member 100 has a generally rectangular cross-section. The sidewall 46 is provided with an implemented T-ear offset dado construction with an elongated slot 91 having sidewalls 92, 93, the dimension between which corresponds to the cross-sectional dimension of the rectangular brace 100. At the bottom of the slot 91, there is provided a flat bottom surface 94 achieved by drilling or routing lobes 96, 98 in order to define the flat surface 94. The slot 91 represented by sidewalls 92, 93 and bottom 94 are thus carefully dimensioned to correspond to the cross-section of the brace member 100, with the bottom 104 of the brace positioned against the flat bottom 94, as shown in FIG. 5. This construction provides an unexpectedly high increase in strength and dimensional rigidity with respect to joints using normal rounded corner dado constructions, and thus imparts the desired characteristics for the particular application of the checkout construction 10 of the present invention.

Figure 7:
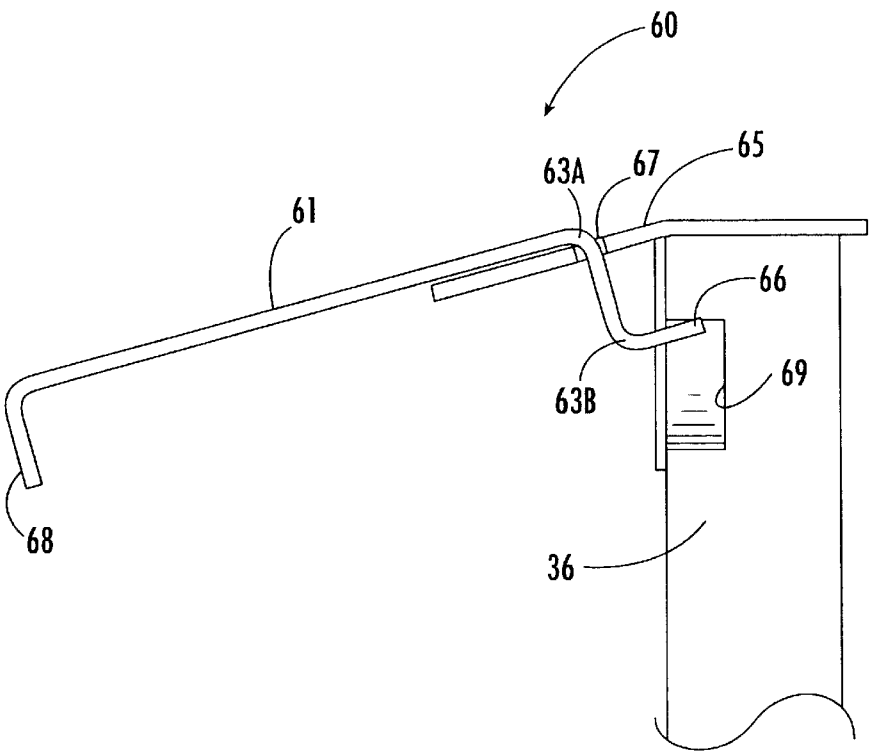
FIGS. 6 and 7 are a perspective view and a cross section, respectively, of a portion of the security module shown in FIG. 3; the view of FIG. 7 is taken along the line 7—7.
Figure 6:
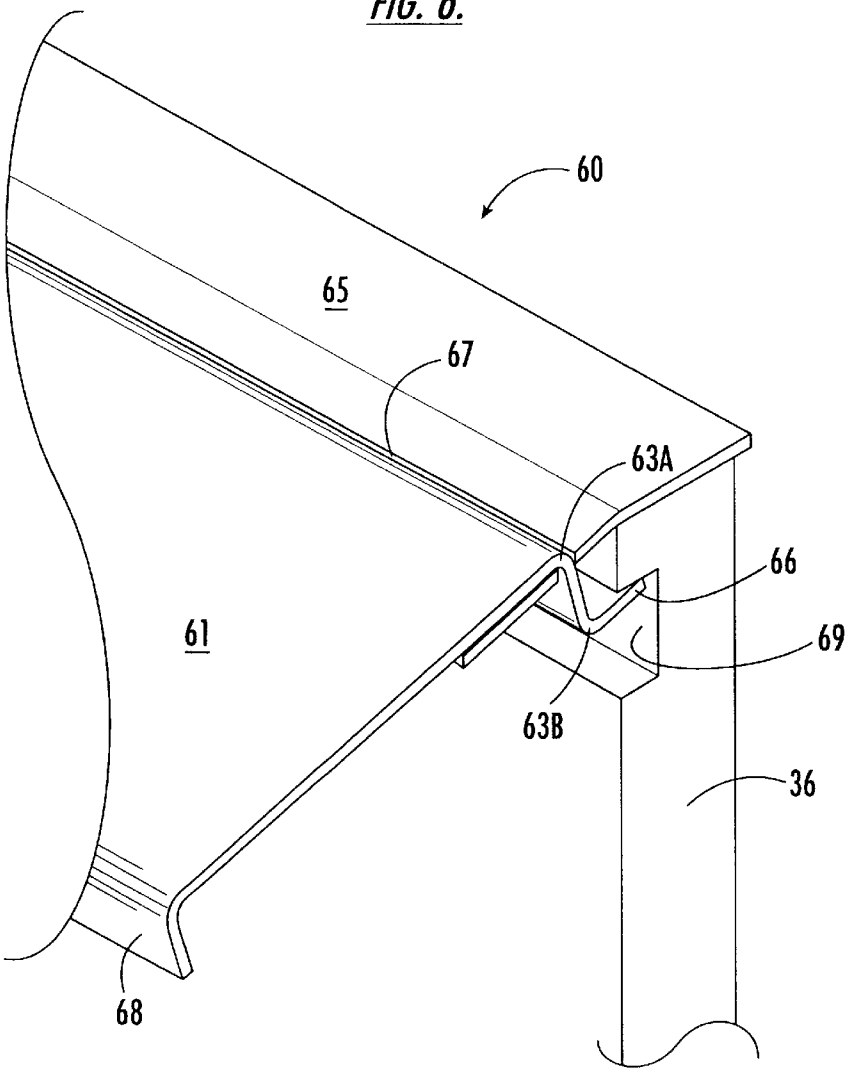

Details regarding the transfer plate assembly of FIGS. 1–3 will now be described with reference to FIGS. 6 and 7.

The transfer plate assembly 60 includes a first, horizontal plate 65 having a slot 67 therein, and a second plate 61 having an angle portion defined by two generally 90° bends 63A and 63B so as to be fitted loosely within the slot 67. The forward extremity 66 of the second plate 61 is dimensioned to abut a recess 69 in the inside surface of intake end 36 of the security module 34 when the rearward end 68 of the second plate 61 is suspended above the conveyor 62; however, the construction of the bends 63A, 63B and the slot 67 permits the rearward extremity 68 of the second plate 61 to be easily rotated upwardly away from the conveyor, in the event that merchandise or a consumer's fingers become inadvertently lodged between the rearward extremity and the conveyor 62.

Figure 8:
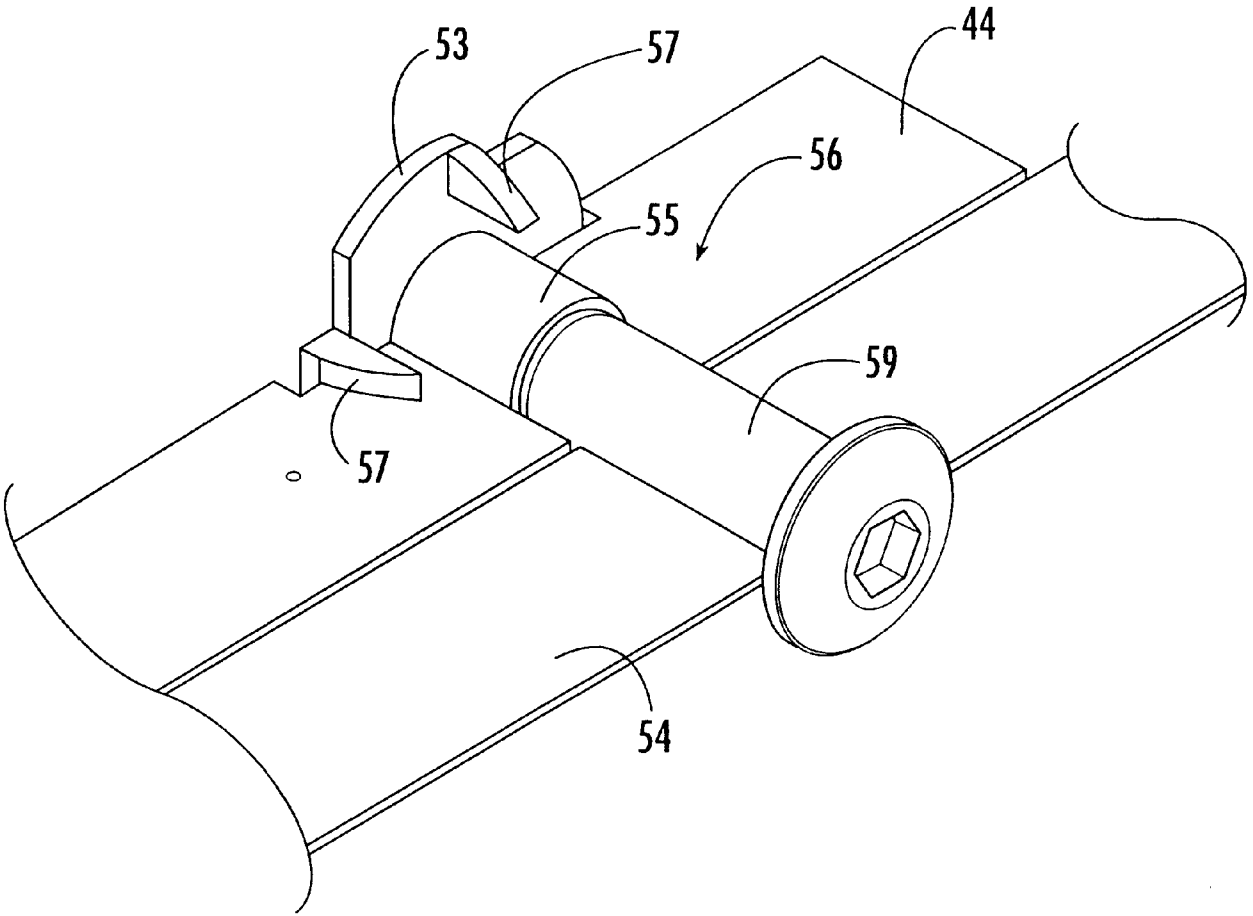
FIG. 8 is a perspective view of a specialized fastener used with the construction of the present invention, with a portion of the associated side and accent panel cut away.

The specialized fastener 56 described above with reference to FIG. 3 is shown in detail in FIG. 8. The fastener 56 in FIG. 8 is shown associated with sidewall 44 and accent panel 54 (both of which are cut away) of the security module 34. The fastener 56 includes a back plate 53 with extending barbs 57 and a tubular projection 55, with the projection 55 having an internal threaded bore dimensioned to receive a machine bolt 59. The back plate 53 is flush with the inside surface of the sidewall 44, with the barbs 57 extending into the sidewall. Removal of the machine bolt 59 in turn permits removal of the accent panel 54 so that the internal recess 48 may be accessed through the ports 50, as described above.

It will be appreciated that the present invention provides a facile modular self-checkout counter construction which imparts the desired stability and rigidity and is not susceptible to misalignment. Further, the construction of the present invention permits easy access to the internal recess for maintenance of the security equipment located therein.

What is claimed is:

1. A construction for use in supermarket and similar checkout counters, the construction comprising:

a counter having an intake end and a discharge end, and a bottom adapted to be supported upon a floor of a retail facility such as a supermarket, the counter having an internal recess defined by sidewalls, the sidewalls having ports permitting access to equipment mounted within the recess;

plural accent panels;

means for mounting each accent panel along an outer surface of a corresponding one of the sidewalls of the counter and over the access ports, the mounting means permitting removal of the accent panels entirely without access to the internal recess;

a conveyor supported by the counter and extending from the intake end to the discharge end;

means for operating the conveyor in a direction from the intake end to the discharge end; and a two-part transfer plate assembly at the intake end, the assembly including a first, horizontal plate having a slot therein and a second plate having an angled portion loosely fitted in the slot to permit restricted rotation of the second plate, the assembly overlying the conveyor at the intake end.

2. The construction recited in claim 1 wherein the accent panel mounting means comprises fasteners extending through each exposed outer surface of the associated accent panel.

3. The construction recited in claim 2, wherein each fastener comprises a first fastener part fixed with an associated sidewall, the first fastener part having a threaded bore and a second threaded fastener part extending through a corresponding accent panel and threaded into the bore.

4. The construction recited in claim 1 further comprising an intake module attached to the intake end of the counter, the intake module dimensioned to be suspended above the floor.

5. The construction recited in claim 1 further comprising:

a packaging module abutting a rearward end of the counter and having an upper packaging surface adapted to receive merchandise which passes from the discharge end of the counter so that the merchandise may be packaged.

6. The construction recited in claim 5 wherein the counter comprises lateral brace members extending between opposing sidewalls thereof, each brace member fitted at each end to an adjacent sidewall.

7. The construction recited in claim 6 wherein each brace member has a generally rectangular cross-section, and wherein each sidewall at a location where an end of a corresponding brace member is fitted thereto includes a recess for receiving a corresponding brace member end, the recess having a relatively flat bottom and sides the dimension between which corresponds to the cross-sectional dimension of the brace member fitted therein.

8. A checkout counter construction useful in supermarkets and other retail facilities, the construction comprising:

a module having an intake end, an opposing discharge end and means between the intake and discharge ends for conveying merchandise along a first direction between the two ends, the module further including means for supporting equipment for detecting characteristics of merchandise passing along the first direction;

a packaging surface positioned to receive articles after passing across the discharge end of the module; and a transfer plate assembly at the intake end of the module, the transfer plate assembly including a first, generally horizontal plate having a slot therein and a second generally horizontal plate having an angled portion at a forward extremity loosely fitted in the slot of the first plate to permit restricted rotation of the second plate.

9. The construction recited in claim 8, further comprising:

the sidewalls of the module having ports permitting access to equipment mounted therein;

plural accent panels; and means for mounting each access panel along an outer surface of a corresponding one of the sidewalls and over the access ports, the mounting means permitting removal of the accent panels entirely without access to the internal recess.

10. The construction recited in claim 9 wherein the mounting means comprises plural fastener assemblies, each fastener assembly including a first fastener part having barbs extending into an associated sidewall, and a second fastener part extending through a corresponding accent panel and removably fitted with the first fastener part.

11. The construction recited in claim 8 wherein the angled portion of the forward extremity of the second plate comprises two generally 90° bends, with a first one of the bends at the slot of the first plate.

12. The construction recited in claim 11 wherein the module includes a recess at the intake end, and wherein the forward extremity of the second plate forward of a second one of the two 90° bends abuts the recess in the intake end when the second plate is rotated downwardly.

13. A construction for use in supermarket and other retail facilities, the construction comprising:

a security module having a bottom adapted to be supported upon a floor of a retail facility such as a supermarket, the security module having an internal recess defined by sidewalls of the module, the recess extending from a top level of the security module to a recess bottom;

a security equipment support platform fixed to the security module across the recess bottom;

the sidewalls of the security module having ports permitting access to security equipment mounted upon the support platform within the recess;

plural accent panels;

a two-part transfer plate attached to and overlying the intake end of the security module, the transfer plate assembly including a first, horizontal plate having a slot therein and a second plate having an angled portion loosely fitted in the slot to permit restricted rotation of the second plate;

an intake module attached to the intake end of the security module, the intake module dimensioned to be suspended above the floor; and a packaging module abutting a rearward end of the security module and having an upper packaging surface adapted to receive merchandise which passes from the discharge end of the security module so that the merchandise may be packaged.

14. The construction recited in claim 13 wherein the security and packaging modules comprise lateral brace members extending across the module between opposing sidewalls thereof, each brace member fitted at each end to an adjacent sidewall of the module and having a generally rectangular cross section, with each sidewall at a location where an end of a corresponding brace member is fitted thereto including a recess for receiving a corresponding brace member end, the recess having a relatively flat bottom and sides the dimension between which corresponds to the cross sectional dimension of the brace member fitted therein.

15. The construction recited in claim 14, wherein the accent panel mounting means comprises fasteners extending through each exposed outer surface of the associated access panel, each fastener comprising a first fastener part fixed with an associated sidewall, the first fastener part having a threaded bore and a second threaded fastener part extending through a corresponding accent panel and threaded into the bore.

16. A checkout counter construction, comprising:

a counter having and intake end and a discharge end, and a conveyor extending across an upper surface of the counter between the intake end and the discharge end;

a transfer plate having a forward extremity rotatably fitted with the counter adjacent the intake end and a rearward extremity overlying the conveyor, whereby rotation of the transfer plate reduces the risk of objects being lodged between the transfer plate and the conveyor; and wherein the counter comprises a slot extending across the intake end, with the forward extremity of the transfer plate rotatable fitted within the slot and the transfer plate comprises a first bend extending through the slot.

17. The construction recited in claim 16 wherein the terminal edge of the rearward extremity of the transfer plate extends generally normal to the conveyor.

18. The construction recited in claim 16 further comprising a second bend in the transfer plate below the slot, whereby the edge of the forward extremity, by virtue of the first and second bends, extends toward the intake end of the counter.

19. The construction recited in claim 18 wherein the counter includes a recess below the slot, with the transfer plate, the first and second bends and the slot dimensioned so that the edge of the forward extremity of the transfer plate extends into the slot.

20. A checkout counter construction comprising:

a counter having and intake end and a discharge end, and a conveyor extending across an upper surface of the counter between the intake end and the discharge end;

a transfer plate having a forward extremity rotatable fitted with the counter adjacent the intake end and a rearward extremity overlying the conveyor, whereby rotation of the transfer plate reduces the risk of objects being lodged between the transfer plate and the conveyor; and an assembly of first and second plates, wherein the first plate is fitted to the counter at the intake end and includes a slot therein extending laterally across the intake end, and the second plate includes a forward extremity loosely fitted in the slot for restricted rotation therein, with the rearward extremity extending over the conveyor.

21. The construction recited in claim 20 wherein the forward, extremity of the second plate comprises two generally 90° bends, with a first one of the bends at the slot of the first plate.

22. The construction recited in claim 20 wherein the counter includes a recess below the intake end, and wherein the forward extremity of the second plate contains a second 90° bend effectuates extension of the edge of the forward extremity of the second plate into the recess of the counter.

* * * * *